US005366178A

United States Patent [19]

Hsiong et al.

[11] Patent Number: 5,366,178

[45] Date of Patent: Nov. 22, 1994

[54] SENSOR WINDOW COMPLIANT MOUNTING ASSEMBLY

[75] Inventors: William Hsiong, Agoura; Thomas P. Marshall, Topanga, both of Calif.

[73] Assignee: Hughes Aircraft Company, Los Angeles, Calif.

[21] Appl. No.: 110,525

[22] Filed: Aug. 23, 1993

[51] Int. Cl.[5] ..... F42C 13/00

[52] U.S. Cl. ..... 244/3.16; 102/213

[58] Field of Search ..... 244/3.16; 102/213; 367/188

[56] References Cited

U.S. PATENT DOCUMENTS

| | | | |
|---|---|---|---|
| 3,920,200 | 11/1975 | Evans et al. | 244/3.16 |
| 4,039,246 | 8/1977 | Voight | 244/3.16 |
| 5,196,644 | 3/1993 | Knight et al. | 102/213 |

*Primary Examiner*—Daniel T. Pihulic

*Attorney, Agent, or Firm*—Charles D. Brown; Randall M. Heald; Wanda K. Denson-Low

[57] ABSTRACT

A sensor window compliant mounting assembly (42), such as used in a missile (20) to protect a sensor (40), has a truncated hemispherical sensor dome window (52) and a dome mount housing (60). The dome mount housing (60) includes a hollow tube (62) with an opening (64), an internal circumferential thread (66) adjacent to the opening (64), and an integral bezel retainer ring (68) extending circumferentially around the opening (64). The bezel retainer ring (68) engages and retains the exterior surface (56) of the dome base (54). A spanner nut (72) is threadably engaged to the internal circumferential thread (66) of the dome mount housing (60), and a partially compressed fiber metal washer (74) reacts between the spanner nut (72) and the lower surface (58) of the dome base (54) to bias the sensor dome window (52) toward the bezel retainer ring (68).

20 Claims, 1 Drawing Sheet

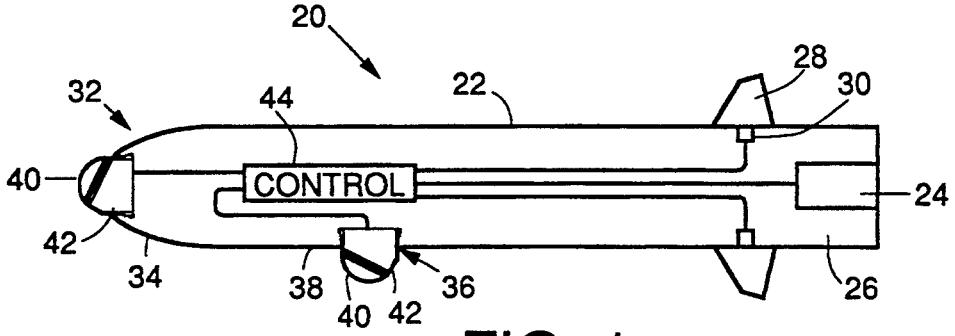
FIG. 1.
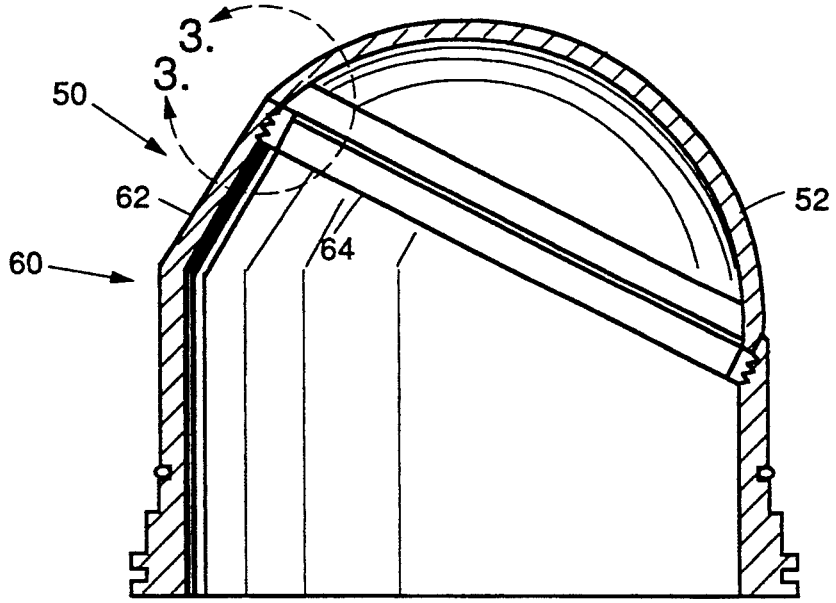
FIG. 2.
FIG. 3.
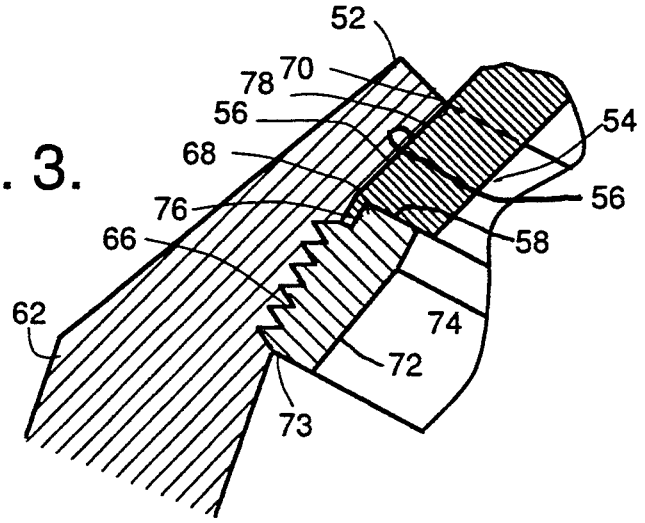

SENSOR WINDOW COMPLIANT MOUNTING ASSEMBLY

"This invention was made with U.S. Government support under Contract N00039-89-C-5301 awarded by the Department of the Navy. The Government has certain rights in this invention."

BACKGROUND OF THE INVENTION

This invention relates to the mounting of sensor windows used to protect sensors, and, more particularly, to a compliant mounting assembly that permits the mounting and window to be heated to elevated temperature without loss of mounting and protective integrity.

Various types of optical, electro-optical, infrared, acoustic, and radar sensors are used in missiles, aircraft, and other applications to sense the environment and especially to search for targets. The sensor itself is usually rather delicate and must be protected from aerodynamic forces, dirt, heat, and other external agents that could damage it. A protective sensor window that is transparent to the energy sensed by the sensor is placed over the sensor to protect it. The sensor window is held in place by a window mounting assembly.

In one application, an infrared sensor is protected by a infrared-transparent ceramic window in the shape of a truncated dome that fits over the sensor and is held in place in a metallic mounting. In conventional practice, an adhesive is used to bond the protective window to the mounting assembly. However, in some cases the sensor system is to be used in an aerodynamic environment where it may be heated to temperatures as high as 1200° F. At such temperatures, conventional adhesives soften and are incapable of holding the protective window in place. Moreover, the differences in thermal expansion coefficients between the ceramic window and the metallic mounting may cause the window to become loose in the mounting so that hot gas could penetrate to the sensor and damage it. Tests using such a conventional approach have led to mounting-related failures.

There is a need for an improved sensor window assembly for a wide variety of sensor systems. The sensor window assembly should withstand elevated temperatures without loss of mounting integrity and protective function. The present invention fulfills this need, and further provides related advantages.

SUMMARY OF THE INVENTION

The present invention provides a sensor window mounting assembly that securely retains the sensor window in place. The assembly may be heated to elevated temperatures without loss of structural or protective functions. The assembly of the invention is fully compatible with existing sensor designs and mechanical constraints imposed by the surrounding structure.

In accordance with the invention, a sensor window compliant mounting assembly comprises a sensor window having a window base with an exterior surface and a lower surface and a window mount housing. The window mount housing includes a hollow tube with an opening at a mounting end thereof, an internal circumferential thread adjacent to the opening, and a bezel retainer ring extending circumferentially around the opening of the window mount housing at the mounting end and having an interior surface. The bezel retainer ring is sized to engage the exterior surface of the window base with the interior surface of the bezel retainer ring and thereby retain the window base therein. A spanner nut is threadably engaged to the internal circumferential thread of the window mount housing. There is further a means for biasing the window toward the bezel retainer ring of the window mount housing, the means for biasing reacting between the spanner nut and the lower surface of the window base.

In a preferred embodiment, a sensor window compliant mounting assembly comprises a truncated hemispherical sensor dome having a dome base with an exterior surface and a lower surface and a dome mount housing. The dome mount housing includes a hollow tube with an opening at a mounting end thereof, an internal circumferential thread adjacent to the opening, and an integral bezel retainer ring extending circumferentially around the opening of the dome mount housing at the mounting end and having an interior surface. The bezel retainer ring is sized to engage the exterior surface of the dome base with the interior surface of the bezel retainer ring and to retain the dome base therein. A sealant is placed between the exterior surface of the dome base and the interior surface of the bezel retainer ring. A spanner nut is threadably engaged to the internal circumferential thread of the dome mount housing. A partially compressed fiber metal washer reacts between the spanner nut and the lower surface of the dome base, and a gasket is placed between the fiber metal washer and the lower surface of the dome base.

In one embodiment, a missile comprises a missile body a sensor in the missile body, a sensor window through which the sensor faces, and a sensor window compliant mounting assembly as set forth herein.

An important feature of the mounting assembly is the means for biasing that compliantly forces the window base into the bezel retainer ring. This means for biasing is preferably a sintered fiber metal washer, but which may be a spring or other type of compliant device. The means for biasing is desirably partially compressed during assembly of the mount. This arrangement holds the window securely to the bezel retainer ring of the mount housing, yet permits a small amount of relative movement responsive to the different thermal expansion and contraction of the window and the housing. This permissible relative movement allows the retention of structural and sealing integrity under aerodynamic forces and heating at temperatures far above those possible with the conventional mounting approach.

The present invention thus provides a advance in the art of sensor systems, and particularly in regard to a mounting assembly that permits use of the sensor system over a wider range of conditions that heretofore possible. Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

FIG. 1 is a schematic side view of infrared sensors mounted in a missile;

FIG. 2 is a side sectional view of a sensor window compliant mounting assembly; and FIG. 3 is a detail of FIG. 2, at location 3—3.

DETAILED DESCRIPTION OF THE INVENTION

FIG. 1 illustrates a missile 20 in which a sensor system and compliant mounting assembly may be used. The missile 20 includes a body 22, an engine 24 in a tail 26 of the body 22 of the missile 20, and aerodynamic control surfaces 28 mounted to the sides of the body 22 of the missile 20. The control surfaces 28 are controllable by motors 30.

A sensor system 32 is mounted in a nose 34 of the body 22 of the missile 20. Another sensor system 36 is mounted on a side 38 of the body 22 of the missile 20. In practice, there is usually only a single sensor system 32 or 36 in any one missile 20. A nose-mounted sensor system 32 is typically present in most such missiles, and a side-mounted sensor system 36 may be present for particular applications. Both types of sensor systems 32 and 36 are shown here for illustrative purposes.

Each sensor system 32 and 36 includes a sensor 40 mounted within a mounting assembly 42. An output signal from the sensor 40 is conveyed to a control unit 44, which processes the signal. The control unit utilizes this and other information to generate and send commands to the control surface motors 30 and the engine 24. This brief description of a missile 20 presents only a general outline of the environment in which the sensor system and mounting assembly may be used. Most missiles include many other features and the described features may be placed differently than shown here.

FIG. 2 illustrates a sensor window compliant mounting assembly 50 for the side-facing sensor system 36, and FIG. 3 illustrates an enlarged detail. The corresponding mounting assembly for the forward-facing sensor system 32 is similar in relevant respects.

The mounting assembly 50 includes a protective window for the sensor. In the illustrated case, the protective window is a truncated hemispherical sensor dome 52 made of a ceramic material such as sapphire that is transparent to infrared radiation. The sensor dome 52 includes a region termed the dome base 54. The dome base 54 has an exterior surface 56 on the outside of the dome 52 and a lower surface 58 defining the truncation of the hemisphere.

The mounting assembly 50 further includes a dome mount housing 60 that includes a hollow tube 62. The hollow tube 62 may be straight, as for a forward-facing sensor system, or may be straight in part and have a slightly angled portion, as for the illustrated side-facing sensor system. The hollow tube has an opening 64 at an end adjacent to the dome base 54. The hollow tube 62 is of sufficiently large diameter that the sensor dome 52 may be pushed through the interior of the hollow tube 62, and to the opening 64. The hollow tube 62 is also internally threaded with an internal thread 66 adjacent to the opening 64 and the sensor dome 52. The utilization of the internal thread 66 will be discussed in more detail subsequently.

Adjacent to the opening 64 and dome base 54, and outwardly from the internal thread 66, the hollow tube 62 is formed into an bezel retainer ring 68 which in this case is integral with the tube 62. The bezel retainer ring 68 is an inwardly tapered end portion of the hollow tube 62. The bezel ring 68 has an interior surface 70. The bezel retainer ring 68 is diametrally sized such that the exterior surface 56 of the dome base 54 slidably engages to the interior surface 70 of the bezel retainer ring 68 when the dome base is pushed through the interior of the hollow tube 62. The sensor dome 52 is thereby retained against outward movement from the hollow tube 62 by the engagement between the exterior surface 56 of the dome base 54 and the interior surface 70 of the bezel retainer ring 68. In this preferred embodiment, the bezel retainer ring 68 is integral with the hollow tube 62. Alternatively, the bezel retainer ring could be provided as a separate piece that is attachable to the end of the hollow tube 62.

A spanner nut 72 has an external thread 73 that matches the internal thread 66 of the hollow tube 62. The spanner nut 72 is threadably engageable to the internal thread 66 of the hollow tube 62.

A means for biasing the sensor dome 52 toward the bezel retainer ring 68 is provided at a location such that the means for biasing reacts between the spanner nut. 72 and the lower surface 58 of the dome base 54. In the preferred embodiment, the means for biasing is a sintered fiber metal washer 74. Such a fiber metal washer 74 is made by forming a felt of small metallic fibers in a loose array and sintering the felt of metallic fibers together, so that each metal fiber acts as a spring. Collectively, the fibers impart a spring-like compliancy to the washer. Such fiber metal washers are known in the art, and are available commercially from Brunswick Technetics, Delano, Fla. Alternatively, other means for biasing such as Belleville, wave, or slotted spring washers, or garter springs, can be used.

Optionally but preferably, a gasket 76 of a material such as a polyimide material can be placed between the fiber metal washer 74 and the lower surface 58 of the dome base 54. Since the sensor dome 52 is preferably a ceramic material, the soft, nonmetallic gasket 76 prevents scratching or other damage to the sensor dome 52 by the fiber metal washer 74, which could lead to premature failure of the sensor dome 52. The presence and use of the gasket 76 is within the scope of the statement that the fiber metal washer 74 mechanically reacts against the lower surface 58 of the dome base 54, because when the gasket 76 is present the mechanical reaction still occurs through the intermediate gasket 76.

A thin sealant layer 78 is located between the interior surface 70 of the bezel retainer ring 68 and the exterior surface 56 of the dome base 54. The sealant is preferably a viscous sealant that withstands the temperature to which the sensor system and mounting assembly are subjected. The sealant need not provide mechanical strength, only a sealing action. A preferred sealant layer 78 is about, 0.002 inches of RTV silicone or a polysulfide material. The RTV silicon sealant is available commercially from General Electric Co., Waterford, N.Y. as Type 630 sealant.

To assemble the mounting assembly 50, the parts as described are first provided. The interior surface 70 of the bezel retainer ring 68 and/or the exterior surface 56 of the dome base 54 are provided with a coating of the sealant material that is to become the sealant layer 78 at the completion of assembly. The sensor dome 52 is inserted dome-end first into the hollow tube 62 until the dome end protrudes through the opening 64. The sensor dome 52 cannot pass through the opening 64, inasmuch as the exterior surface 56 of the dome base 54 slidably engages the interior surface 70 of the bezel retainer ring 68.

The gasket 76, when used, is inserted into the hollow tube 62 and placed against the lower surface 58 of the dome base 54. The fiber metal washer 74 or other means for biasing is inserted into the hollow tube 62 and placed against the lower surface 58 of the dome base 54, or against the gasket 76 when used. The spanner nut 72 is inserted into the hollow tube 62 and threadably engaged to the internal threads 66. The spanner nut 72 is tightened slightly, so that the fiber metal washer 74 or other means for biasing is preloaded and partially compressed during ambient temperature assembly. The spanner nut 72 may optionally be locked into place.

The preloaded fiber metal washer 74 or other means for biasing holds the dome base 54 firmly against the bezel retainer ring 68. The retention is completely mechanical. There is no dependence for retention upon an adhesive that could weaken and fail during service.

The retention of the sensor dome 52 is compliant and resistant to failure during heating or cooling as a result in the difference in thermal expansion of the sensor dome 52 and the other components of the assembly 50. In an environment where the sensor dome 52 enlarges relative to the hollow tube 62, the fiber metal washer 74 compresses further. In an environment where the hollow tube 62 enlarges relative to the sensor dome 52, the fiber metal washer 74 expands to retain a tight joint between the bezel retainer ring 68 and the dome base 54. Because the heating and the temperature of the mounting assembly 50 are not uniform during a typical aerodynamic heating cycle, the actual temperature distribution is not readily predicted. The approach of the invention retains a tight, compliant seal of the sensor dome 52 to the hollow tube 62 regardless of the temperature distribution within a normal operating range. In most cases, a slight leakage is acceptable.

Although a particular embodiment of the invention has been described in detail for purposes of illustration, various modifications may be made without departing from the spirit and scope of the invention. Accordingly, the invention is not to be limited except as by the appended claims.

What is claimed is:

1. A sensor window compliant mounting assembly, comprising:

a sensor window having a window base with an exterior surface and a lower surface;

a window mount housing, the window mount housing including a hollow tube with an opening at a mounting end thereof, an internal circumferential thread adjacent to the opening, and a bezel retainer ring extending circumferentially around the opening of the window mount housing at the mounting end and having an interior surface, the bezel retainer ring being sized to engage the exterior surface of the window base with the interior surface of the bezel retainer ring and thereby retain the window base therein;

a spanner nut threadably engaged to the internal circumferential thread of the window mount housing; and means for biasing the window toward the bezel retainer ring of the window mount housing, the means for biasing reacting between the spanner nut and the lower surface of the window base.

2. The assembly of claim 1, wherein the sensor window is a truncated hemispherical dome.

3. The assembly of claim 1, wherein the bezel retainer ring is integral with the window mount housing.

4. The assembly of claim 1, further including a gasket sized to fit between the means for biasing and the window base.

5. The assembly of claim 1, further including a sealant between the exterior surface of the window base and the interior surface of the bezel retainer ring.

6. The assembly of claim 1, wherein the means for biasing is a reversibly compressible material.

7. The assembly of claim 1, wherein the means for biasing is partially compressed.

8. The assembly of claim 1, wherein the means for biasing includes a sintered fiber metal washer.

9. A sensor window compliant mounting assembly, comprising:

a truncated hemispherical sensor dome having a dome base with an exterior surface and a lower surface;

a dome mount housing, the dome mount housing including a hollow tube with an opening at a mounting end thereof, an internal circumferential thread adjacent to the opening, and an integral bezel retainer ring extending circumferentially around the opening of the dome mount housing at the mounting end and having an interior surface, the bezel retainer ring being sized to engage the exterior surface of the dome base with the interior surface of the bezel retainer ring and to retain the dome base therein;

a sealant between the exterior surface of the dome base and the interior surface of the bezel retainer ring;

a spanner nut threadably engaged to the internal circumferential thread of the dome mount housing;

a partially compressed fiber metal washer reacting between the spanner nut and the lower surface of the dome base; and a gasket between the fiber metal washer and the lower surface of the dome base.

10. The assembly of claim 9, wherein the sensor dome is made of a material that is transparent to infrared radiation.

11. The assembly of claim 9, wherein the sensor dome is made of sapphire.

12. The assembly of claim 9, wherein the fiber metal washer has a sintered structure.

13. A missile comprising a sensor system, the sensor system including a missile body;

a sensor in the missile body;

a sensor window through which the sensor faces, the sensor window having a window base with an exterior surface and a lower surface;

a window mount housing, the window mount housing including a hollow tube with an opening at a mounting end thereof, an internal circumferential thread adjacent to the opening, and a bezel retainer ring extending circumferentially around the opening of the window mount housing at the mounting end and having an interior surface, the bezel retainer ring being sized to engage the exterior surface of the window base with the interior surface of the bezel retainer ring and thereby retain the window base therein;

a spanner nut threadably engaged to the internal circumferential thread of the window mount housing; and means for biasing the window toward the bezel retainer ring of the window mount housing, the means for biasing reacting between the spanner nut and the lower surface of the window base.

14. The missile of claim 13, wherein the sensor window is a truncated hemispherical dome.

15. The missile of claim 13, wherein the bezel retainer ring is integral with the window mount housing.

16. The missile of claim 13, further including a gasket sized to fit between the means for biasing and the window base.

17. The missile of claim 13, further including a sealant between the exterior surface of the window base and the interior surface of the bezel retainer ring.

18. The missile of claim 13, wherein the means for biasing is a reversibly compressible material.

19. The missile of claim 13, wherein the means for biasing is partially compressed.

20. The missile of claim 13, wherein the means for biasing includes a sintered fiber metal washer.

* * * * *